US011224284B2

(12) United States Patent
Speicher et al.

(10) Patent No.: US 11,224,284 B2
(45) Date of Patent: Jan. 18, 2022

(54) PERSONAL CARE SYSTEM AND FLUID SUPPLY SYSTEM THEREOF

(71) Applicant: Colgate-Palmolive Company, New York, NY (US)

(72) Inventors: Erin Speicher, Hoboken, NJ (US); Leighton Davies-Smith, Lebanon, NJ (US)

(73) Assignee: Colgate-Palmolive Company, New York, NY (US)

( * ) Notice: Subject to any disclaimer, the term of this patent is extended or adjusted under 35 U.S.C. 154(b) by 152 days.

(21) Appl. No.: 16/793,172

(22) Filed: Feb. 18, 2020

(65) Prior Publication Data

US 2021/0251378 A1 Aug. 19, 2021

(51) Int. Cl.

| | |
|---|---|
| ***B43K 8/06*** | (2006.01) |
| ***A46B 11/00*** | (2006.01) |
| ***A46B 9/04*** | (2006.01) |

(52) U.S. Cl.

CPC ..... *A46B 11/0062* (2013.01); *A46B 9/04* (2013.01); *A46B 11/0082* (2013.01); *A46B 2200/1066* (2013.01)

(58) Field of Classification Search

CPC ..... A46B 11/0082; A46B 11/0062; A46B 2200/1066; A46B 9/04

USPC ..... 401/198

See application file for complete search history.

(56) References Cited

U.S. PATENT DOCUMENTS

| | | | |
|---|---|---|---|
| 4,186,856 | A | 2/1980 | Dirsking |
| 4,886,389 | A | 12/1989 | Vidovic |
| 5,033,898 | A | 7/1991 | Williams |
| 5,098,297 | A | 3/1992 | Chari et al. |
| 5,309,590 | A | 5/1994 | Giuliani et al. |
| 5,611,687 | A | 3/1997 | Wagner |
| 6,095,707 | A | 8/2000 | Kaufmann |
| 6,371,674 | B1 | 4/2002 | Lerner |
| 6,416,242 | B1 | 7/2002 | Kaufmann |
| 7,887,246 | B2 | 2/2011 | Hori |

(Continued)

FOREIGN PATENT DOCUMENTS

| | | |
|---|---|---|
| EP | 1030383 | 6/1912 |
| EP | 3054808 | 8/2016 |

(Continued)

OTHER PUBLICATIONS

International Search Report and the Written Opinion of the International Searching Authority issued in International Application PCT/US2021/070152 dated Jun. 28, 2021.

*Primary Examiner* — Jennifer C Chiang

(57) ABSTRACT

A personal care system or fluid supply system with components specifically designed and arranged to speed up the process of initially priming an applicator of the personal care system with a fluid. The personal care system may include a personal care implement having an applicator and a fluid supply system disposed within the personal care implement. The fluid supply system may include multiple reservoirs, both filled with a fluid, and one of which has an absorbent member disposed therein. A first capillary member may extend from one of the reservoirs to the applicator and a second capillary member may extend from the reservoir with the absorbent member therein to the applicator. The fluid may travel faster along the second capillary member to speed up the priming process.

20 Claims, 7 Drawing Sheets

(56) References Cited

U.S. PATENT DOCUMENTS

| | | | | |
|---|---|---|---|---|
| 8,398,326 | B2 | 3/2013 | Jimenez et al. | |
| 8,517,728 | B2 | 8/2013 | Gatzemeyer et al. | |
| 8,529,150 | B2 | 9/2013 | Olson | |
| 9,414,668 | B2 * | 8/2016 | Worthington | A46B 11/001 |
| 9,554,641 | B2 * | 1/2017 | Worthington | B05C 11/105 |
| 9,603,444 | B2 * | 3/2017 | Boyd | A46B 11/0055 |
| 9,700,130 | B2 | 7/2017 | Kennedy et al. | |
| 10,376,040 | B2 | 8/2019 | Davies-Smith et al. | |
| 10,390,607 | B2 | 8/2019 | Davies-Smith et al. | |
| 10,398,216 | B2 | 9/2019 | Davies-Smith et al. | |
| 10,638,832 | B1 * | 5/2020 | Davies-Smith | A46B 11/0006 |
| 10,638,932 | B2 * | 5/2020 | Gliner | A61B 5/015 |

FOREIGN PATENT DOCUMENTS

| | | |
|---|---|---|
| WO | 2017/116400 | 7/2017 |
| WO | 2020/101847 A1 | 5/2020 |

* cited by examiner

PERSONAL CARE SYSTEM AND FLUID SUPPLY SYSTEM THEREOF

BACKGROUND

Fluid supply systems are used to store a fluid that is later dispensed onto a surface. Examples of fluid supply systems include writing instruments, liquid dispensers, liquid applicators, and the like. Personal care implements, particularly oral care implements such as toothbrushes, are typically used by applying dentifrice or toothpaste to tooth cleaning elements such as bristles followed by brushing regions of the oral cavity, e.g., the teeth, tongue, and/or gums. Some oral care implements have been equipped with fluid reservoirs and systems for dispensing auxiliary oral care fluids from an applicator on the oral care implement before, during, and/or after the tooth brushing regimen. One issue with existing fluid supply systems and personal care implements containing the same is the amount of time that it takes to prime the applicator with the fluid renders the manufacture of such products infeasible for mass production. An improved fluid supply system and personal care system containing the same is desired to address this and other issues.

BRIEF SUMMARY

The present invention is directed to a personal care system or fluid supply system with components specifically designed and arranged to speed up the process of initially priming an applicator of the personal care system with a fluid. The personal care system may include a personal care implement having an applicator and a fluid supply system disposed within the personal care implement. The fluid supply system may include multiple reservoirs, both filled with a fluid, and one of which has an absorbent member disposed therein. A first capillary member may extend from one of the reservoirs to the applicator and a second capillary member may extend from the reservoir with the absorbent member therein to the applicator. The fluid may travel faster along the second capillary member to speed up the priming process.

In one aspect, the invention may be a personal care system comprising: a personal care implement comprising a cavity and an applicator; and a fluid supply system at least partially disposed within the cavity of the personal care implement, the fluid supply system comprising: a housing defining a first reservoir and a second reservoir, the first reservoir at least partially filled with a fluid; an absorbent member located in the second reservoir and at least partially saturated with the fluid; a first capillary member in fluid coupling with the fluid in the first reservoir and with the applicator to form a first flow path for the fluid from the fluid supply system to the applicator; and a second capillary member in fluid coupling with the absorbent member and with the applicator to form a second flow path for the fluid from the fluid supply system to the applicator, the second flow path being distinct from the first flow path.

In another aspect, the invention may be a personal care system comprising: an applicator; and a fluid supply system comprising: a first reservoir and a second reservoir; an absorbent member located in the second reservoir; a first capillary member having a first portion located within the first reservoir and a second portion in contact with the applicator; and a second capillary member having a first portion in contact with the absorbent member and a second portion in contact with the applicator.

In yet another aspect, the invention may be a personal care system comprising: an applicator; and a fluid supply system comprising: a storage cavity at least partially filled with a fluid; a first capillary member in fluid coupling with the fluid in the storage cavity and with the applicator to form a first flow path for the fluid from the fluid supply system to the applicator, the first capillary member formed of a non-absorbent material; and a second capillary member in fluid coupling with the fluid in the storage cavity and with the applicator to form a second flow path for the fluid from the fluid supply system to the applicator, the second capillary member formed of an absorbent material.

In still another aspect, the invention may be a fluid supply system comprising: a housing extending along an axis from a first end to a second end, the housing comprising a first reservoir and a second reservoir; an absorbent member located in the second reservoir; a fluid in the first and second reservoirs, the fluid in the second reservoir at least partially saturating the absorbent member; a first capillary member in fluid coupling with the fluid in the first reservoir, the first capillary member extending through a first opening in the second end of the housing; and a second capillary member in fluid coupling with the absorbent member, the second capillary member extending through a second opening in the second end of the housing.

In a further aspect, the invention may be a method of priming an applicator of a personal care implement comprising: flowing a fluid along a first capillary member from a first reservoir of a fluid supply system to an applicator of a personal care implement along a first fluid flow path; flowing the fluid along a second capillary member from a second reservoir of the fluid supply system to the applicator of the personal care implement along a second fluid flow path; and wherein the fluid flowing along the second fluid flow path reaches the applicator before the fluid flowing along the first fluid flow path.

In another aspect, the invention may be a method of priming an applicator of a personal care implement comprising: flowing a fluid along a first capillary member from a first reservoir of a fluid supply system to an applicator of a personal care implement along a first fluid flow path; flowing the fluid along a second capillary member from a second reservoir of the fluid supply system to the applicator of the personal care implement along a second fluid flow path; and wherein the first capillary member is formed of a non-absorbent material and the second capillary member is formed of an absorbent material.

In still another aspect, the invention may be a personal care system comprising: an applicator; a first reservoir at least partially filled with a fluid; a second reservoir; an absorbent member located in the second reservoir, the absorbent member at least partially saturated with the fluid; a first capillary member having a first portion located within the first reservoir and a second portion in contact with the applicator to carry the fluid from the first reservoir to the applicator; and a second capillary member having a first portion in contact with the absorbent member and a second portion in contact with the applicator to carry the fluid from the second reservoir to the applicator.

In a further aspect, the invention may be a method of priming an applicator of a personal care implement, the method comprising: pouring a fluid into a storage cavity of a handle of a personal care implement, the fluid flowing into and saturating an absorbent member located in a first portion of the storage cavity; upon the absorbent member becoming saturated with the fluid, the fluid at least partially filling a second portion of the storage cavity; and flowing the fluid from the absorbent member to the applicator to saturate the applicator with the fluid.

In a still further aspect, the invention may be a method of priming an applicator of a personal care implement, the method comprising: introducing a fluid into a storage cavity of a handle of a personal care implement while the personal care implement is in an upside-down orientation, a first portion of the fluid saturating an applicator on the head portion of the personal care implement and a second portion of the fluid at least partially filling the storage cavity; rotating the personal care implement into an upright orientation; and flowing the second portion of the fluid from the storage cavity to the applicator along a capillary member.

In yet a further aspect, the invention may be a personal care system comprising: an applicator; and a fluid supply system comprising: a storage cavity at least partially filled with a fluid; a first capillary member comprising a first end located in the storage cavity and a second end that is in contact with the applicator, the first end located a first distance from the applicator; and a second capillary member comprising a first end located in the storage cavity and a second end that is in contact with the applicator, the first end located a second distance from the applicator; and wherein the first distance is greater than the second distance.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
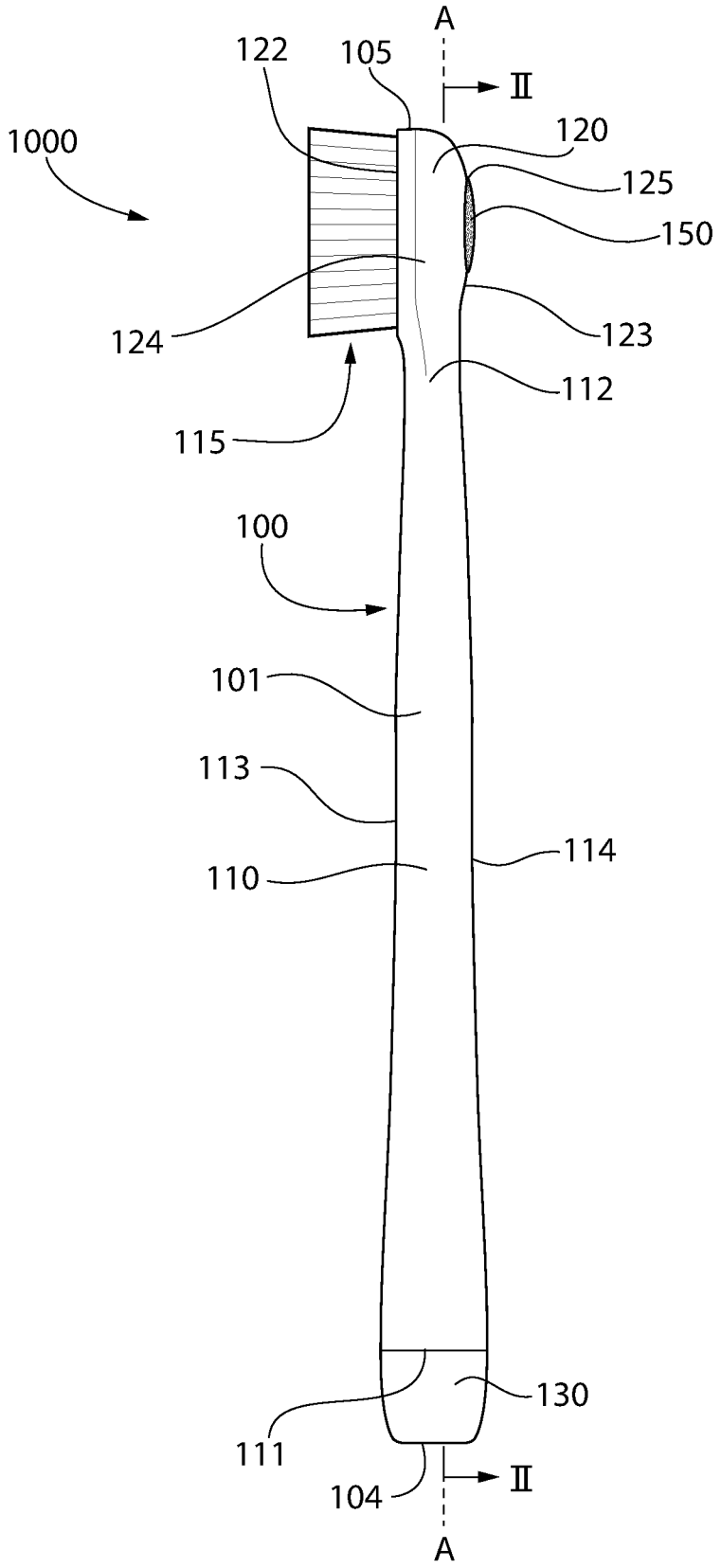
FIG. 1 is side view of a personal care system in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Figure 2:
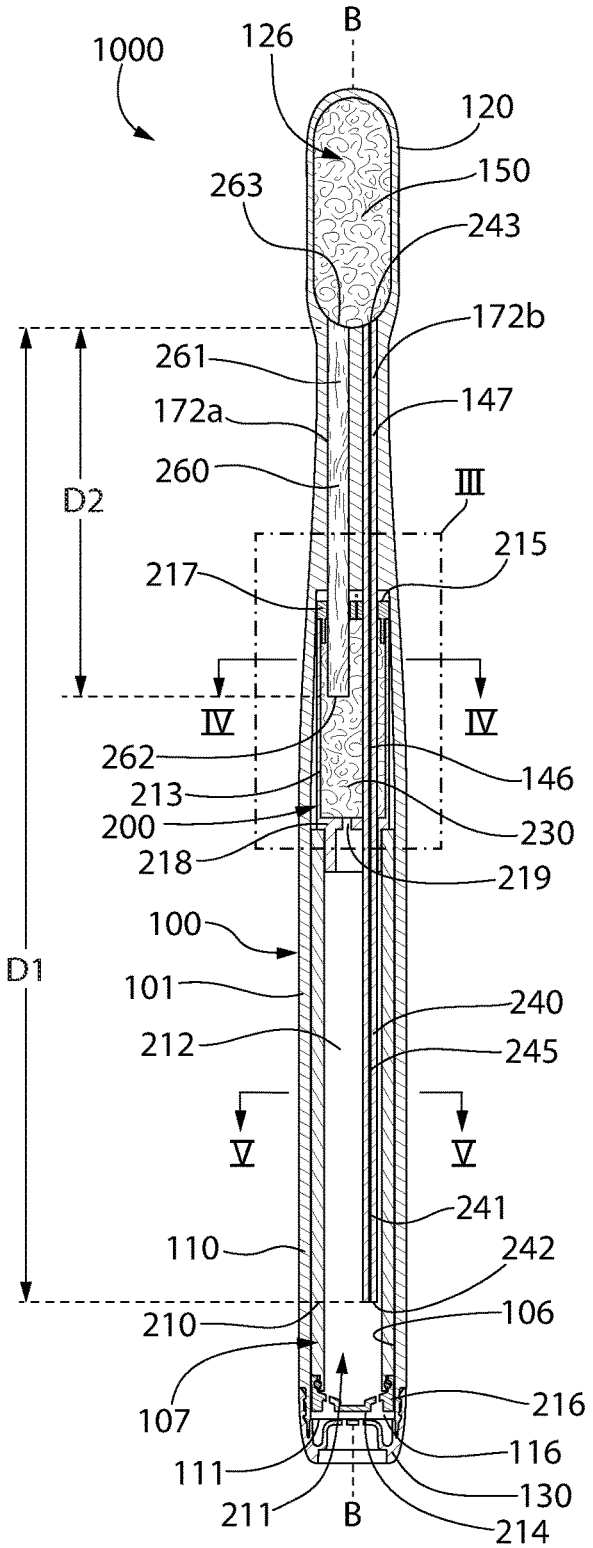
FIG. 2 is a cross-sectional view taken along line II-II of FIG. 1.
Figure 3:
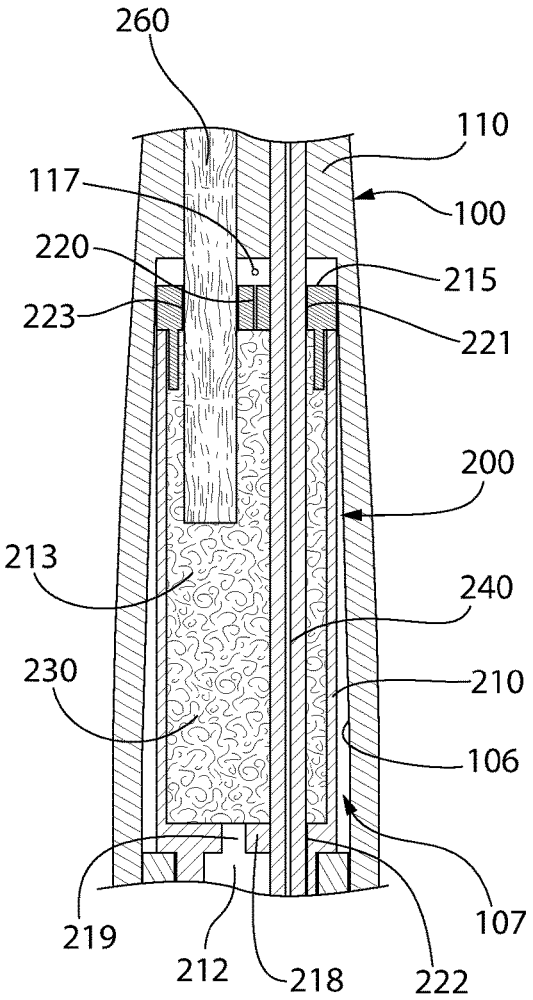
FIG. 3 is a close-up view of area III of FIG. 2.
Figure 4:
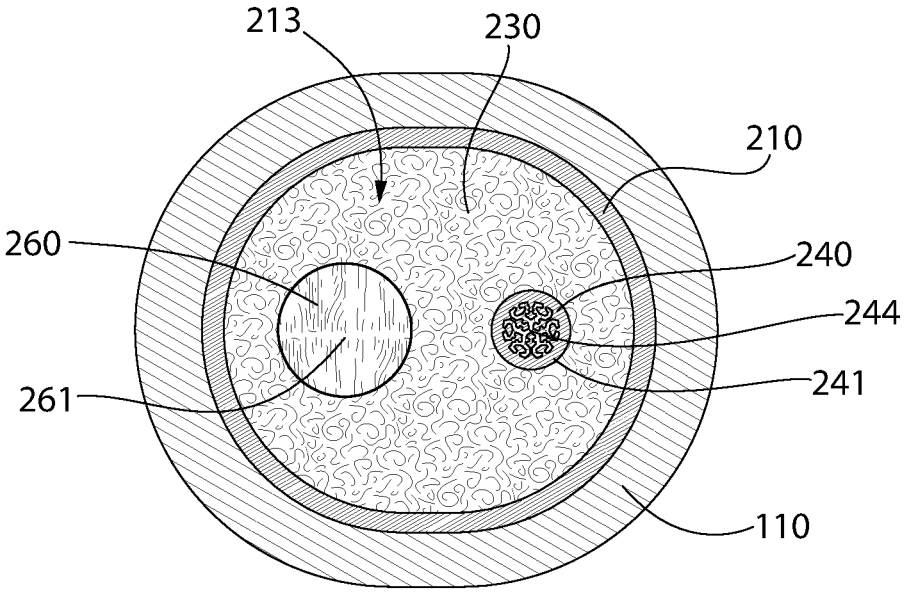
FIG. 4 is a cross-sectional view taken along line IV-IV of FIG. 2.
Figure 5:
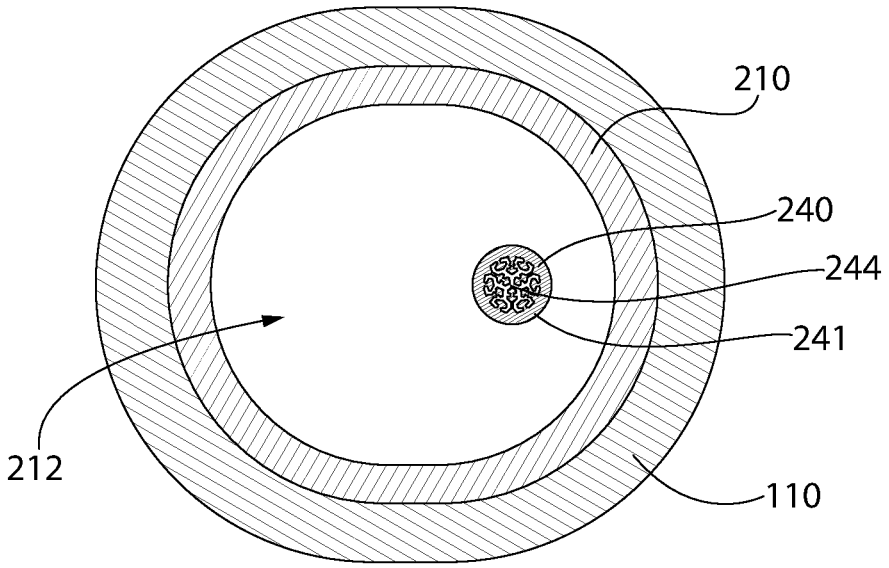
FIG. 5 is a cross-sectional view taken along line V-V of FIG. 2.

Referring first to FIGS. 1-3, a personal care system 1000 is illustrated in accordance with an embodiment of the present invention. The personal care system 1000 generally comprises a personal care implement 100 and a fluid supply system 200. In certain embodiments the fluid supply system 200 may be partially or entirely stored within the personal care implement 100. In some embodiments, the invention may be directed to the fluid supply system 200 regardless of whether it is a stand-alone system or one which is incorporated into or otherwise housed within the personal care implement 100 or within some other structure or implement.

In the exemplified embodiment, the personal care implement 100 is an oral care implement, and more specifically a manual toothbrush. Thus, the invention will be described herein with the details predominately directed to a toothbrush. However, in certain other embodiments the personal care implement 100 can take on other forms such as being a powered toothbrush, a tongue scraper, a gum and soft tissue cleanser, a water pick, an interdental device, a tooth polisher, a specially designed ansate implement having tooth engaging elements, or any other type of implement that is commonly used for oral care. Still further, the personal care implement 100 may not be one that is specifically used for oral care in all embodiments, but rather it may be an implement such as a deodorant application implement, a face or body cleaning implement, a make-up applicator implement, a razor or shaving implement, a hairbrush, or the like. Thus, it is to be understood that the inventive concepts discussed herein can be applied to any type of personal care implement unless a specific type of personal care implement is specified in the claims. Furthermore, in some embodiments the invention is directed solely to the fluid supply system 200. Thus, the fluid supply system 200 may be included in the personal care implement 100 or it may be a separate, stand-alone device. When a stand-alone device, the fluid supply system 200 may include some type of applicator or may otherwise be fluidly coupled to an applicator so that the fluid dispensed from the fluid supply system 200 can be properly applied to a desired surface.

In the exemplified embodiment, the personal care implement 100 generally includes a body 101 comprising a handle 110 and a head 120 and an end cap 130 that is detachably coupled to the handle 110. The body 101 generally extends along a longitudinal axis A-A from a proximal end 104 to a distal end 105. Conceptually, the longitudinal axis A-A is a reference line that is generally coextensive with the three-dimensional center line of the body 101. Because the body 101 may, in certain embodiments, be a non-linear structure, the longitudinal axis A-A of the body 101 may also be non-linear in certain embodiments. However, the invention is not to be so limited in all embodiments and in certain other embodiments the body 101 may have a simple linear arrangement and thus a substantially linear longitudinal axis A-A.

The handle 110 extends from a proximal end 111 to a distal end 112 and the head 120 is coupled to the distal end 112 of the handle 110. More specifically, in the exemplified embodiment the head 120 is integrally formed with the handle 110 and thus the head 120 merely extends from the distal end 112 of the handle 110. In the exemplified embodiment, the end cap 130 is detachably coupled to the proximal end 111 of the handle 120. Specifically, the handle 120 has an opening 116 at the proximal end 111 thereof and the end cap 130 is coupled to the proximal end 111 of the handle 120 and closes the opening 116. The end cap 130 may be detachable from the handle 120 so that a fluid or oral care material can be stored within the body 101 and can be refilled by detaching the end cap 130 from the handle 110 to provide access, via the opening 116, to a cavity/reservoir in the body 101 within which the fluid may be stored. Furthermore, in certain embodiments the end cap 130 may be altogether omitted and the proximal end 111 of the body 101 may form a closed bottom end of the personal care implement 100. In such embodiments, refill of the reservoir may not be possible or may occur through other mechanisms/structures or openings at other locations along the personal care implement 100.

The handle 110 is an elongated structure that provides the mechanism by which the user can hold and manipulate the personal care implement 100 during use. The handle 110 comprises a front surface 113 and an opposing rear surface 114. In the exemplified embodiment, the handle 110 is generically depicted having various contours for user comfort. Of course, the invention is not to be so limited in all embodiments and in certain other embodiments the handle 110 can take on a wide variety of shapes, contours and configurations, none of which are limiting of the present invention unless so specified in the claims.

In the exemplified embodiment, the handle 110 is formed of a rigid plastic material, such as, for example without limitation, polymers and copolymers of ethylene, propylene, butadiene, vinyl compounds, and polyesters such as polyethylene terephthalate. Of course, the invention is not to be so limited in all embodiments and the handle 110 may include a resilient material, such as a thermoplastic elastomer, as a grip cover that is molded over portions of or the entirety of the handle 110 to enhance the gripability of the handle 110 during use. For example, portions of the handle 110 that are typically gripped by a user's palm during use may be overmolded with a thermoplastic elastomer or other resilient material to further increase comfort to a user.

The head 120 of the personal care implement 100 is coupled to the handle 110 and comprises a front surface 122, an opposing rear surface 123, and a peripheral surface 124 extending between the front and rear surfaces 122, 123. In the exemplified embodiment, the head 120 is formed integrally with the handle 110 as a single unitary structure using a molding, milling, machining or other suitable process. Thus, the head 120 extends seamlessly from the handle 110 as noted above and as shown in the drawings. However, in other embodiments the handle 110 and the head 120 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. In some embodiments the head 120 may be detachable from the handle 110 such that mechanical connection features exist on the handle 110 and/or the head 120 to facilitate a detachable coupling therebetween. The head 120 may be formed of any of the materials discussed above with regard to the handle 110.

In the exemplified embodiment, the head 120 of the personal care implement 100 is provided with a plurality of tooth cleaning elements 115 extending from the front surface 122. Of course, depending on the particular type of device selected for the personal care implement 100, the tooth cleaning elements 115 may be replaced with some other bristle-like elements (for example when the personal care implement 100 is a hairbrush or a mascara applicator) or may be altogether omitted. Furthermore, in the exemplified embodiment the tooth cleaning elements 115 are generically illustrated. In certain embodiments the exact structure, pattern, orientation and material of the tooth cleaning elements 115 are not to be limiting of the present invention. Thus, as used herein, the term "tooth cleaning elements" is used in a generic sense to refer to any structure that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof, and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

The tooth cleaning elements 115 may be coupled to the head using any of various known techniques, including staples, in-mold tufting, anchor-free tufting ("AFT"), and PTt. For example, in AFT the tooth cleaning elements 115 are mounted on a head plate and the bottom ends of the tooth cleaning elements 115 are melted to form a melt mat. The head plate is a separate and distinct component from the body 101 of the personal care implement 100. Once the tooth cleaning elements 115 are mounted to the head plate, the head plate is connected to the body 101 by any suitable technique known in the art, including without limitation thermal or ultrasonic welding, any fusion techniques such as thermal fusion, melting, a tight-fit assembly, a coupling sleeve, threaded engagement, adhesion, or fasteners.

In PTt, the tooth cleaning elements 115 are coupled to the head 120 using the following process: end-rounding the bristle filaments and arranging them in a desired tuft pattern; melting the individual filaments together to form tufts that have a mushroom shaped end; inserting the tufts into pre-cored holes of a toothbrush handle/head; and applying pressure and heat for a pre-determined period of time so that the surface of the brush head shapes itself to enclose the mushroom-shaped ends of the tufts, thereby holding them firmly in the head.

Alternatively, the tooth cleaning elements 115 may be connected to the head 120 using AMR techniques, stapling, or the like. The invention is not to be particularly limited by the manner in which the tooth cleaning elements 115 are coupled to the head 120 in all embodiments.

Although not illustrated herein, in certain embodiments the head 120 may also include a soft tissue cleanser coupled to or positioned on its rear surface 123. An example of a suitable soft tissue cleanser that may be used with the present invention and positioned on the rear surface 123 of the head 120 is disclosed in U.S. Pat. No. 7,143,462, issued Dec. 5, 2006 to the assignee of the present application, the entirety of which is hereby incorporated herein by reference. In certain other embodiments, the soft tissue cleanser may include protuberances, which can take the form of elongated ridges, nubs, or combinations thereof. Of course, the invention is not to be so limited and in certain embodiments the personal care implement 100 may not include any soft tissue cleanser.

Still referring to FIGS. 1-3, in the exemplified embodiment the personal care implement 100 comprises an applicator 150 located on or along the head 150. In the exemplified embodiment, the applicator 150 is exposed along the rear surface 123 of the head 120. More specifically, the head 120 has an opening 125 that extends from the rear surface 123 of the head 120 into a basin cavity 126 of the head 120 (the basin cavity 126 being an empty or hollow space between the front and rear surfaces 122, 123 of the head 120). The applicator 150 is inserted into the basin cavity 126 of the head 120 and extends through the opening 125 and protrudes from the rear surface 123 of the head 120. The applicator 150 need not protrude from the rear surface 123 of the head 120 in all embodiments but could be exposed along the rear surface 123 and flush with the rear surface 123 in other embodiments so long as the fluid in the applicator 150 can be dispensed as described herein. Specifically, during use of the personal care implement 100 to brush teeth, the applicator 150 will engage/contact the user's oral surfaces and dispense a fluid thereon as discussed in more detail below. Although the applicator 150 is shown being exposed on the rear surface 123 of the head 120 in the exemplified embodiment, in other embodiments the applicator 150 may be exposed along the front surface 122 of the head 120 or along the peripheral surface 124 of the head 120. In still other embodiments, in may be possible to position the applicator 150 along the handle 110, such as at the proximal end 111 of the handle 110 for example. Thus, the exact location and position of the applicator 150 is not to be limiting of the present invention unless so specified in the claims.

The applicator 150 may be formed of an absorbent material (also referred to as a capillary material) that is capable of being loaded, soaked, or saturated with a fluid that can then be dispensed when the applicator 150 is compressed. For example, the applicator 150 may be a porous material such as a porous foam such as including without limitation a polyurethane foam or other open cell porous material. In the exemplified embodiment the applicator 150 can be formed of any type of material through which a liquid can travel via capillary action or capillary flow. The material of the applicator 150 should be able to soak up a fluid (e.g., liquid) easily so that the fluid can be transported to the applicator 150 for replenishment as described herein. When the applicator 150 is compressed during use, such as when the applicator 150 is being pressed against a surface on which it is desired to dispense the fluid (i.e., an oral cavity surface, a skin surface, or any other surface), the fluid will be dispensed similar to how a sponge releases a liquid when squeezed.

The absorbent material of the applicator 150 may be a porous material, a fibrous material, a foam material, a sponge material, natural fibers, sintered porous materials, porous or fibrous polymers or other materials which conduct the capillary flow of liquids or other materials that are configured to naturally soak of liquid. Of course, the absorbent material is not to be limited by the specific materials noted herein in all embodiments, but can be any material that facilitates movement of a liquid therethrough via capillary action. Furthermore, although described herein as being formed of an absorbent material, the invention is not to be so limited in all embodiments and some alternative embodiments will be described herein below. For example, in certain embodiments the applicator 150 may be formed of a plastic material or a rubber material and may have an orifice formed therethrough to enable the fluid to flow through the applicator 150 for application to a biological surface such as a user's oral cavity, facial surfaces, or the like.

The handle 110 of the personal care implement 100 comprises an inner surface 106 that defines a handle cavity 107. The handle cavity 107 is closed at its bottom end via the end cap 130 that closes the opening 116 at the proximal end 111 of the handle 110. The handle cavity 107 is open at its top end so as to be in spatial and/or fluid communication with the opening 125 on the rear surface 123 of the head 120. More specifically, the handle cavity 107 is in communication with the opening 125 in the head 120 via one or more passageways 172*a*, 172*b* that extend through the neck region of the personal care implement 100.

In the exemplified embodiment, the fluid supply system 200 comprises a housing 210 defining a storage cavity 211. In the exemplified embodiment, the housing 210 of the fluid supply system 200 is positioned within the handle cavity 107. Although the housing 210 is illustrated as being wholly encased within the handle cavity 107, the invention is not to be so limited in all embodiments and the housing 210 may extend into one of the passageways 172*a*, 172*b* or it may even protrude from the proximal end 111 of the handle 110 in some alternative embodiments. However, fully enclosing the housing 210 within the handle cavity 107 provides a more desirable aesthetic as the overall appearance of the personal care implement 100 is similar to that of a traditional device of the same type.

The storage cavity 211 is designed to hold a fluid (i.e., a store of fluid) such that the fluid can be transmitted to the applicator 150 as described herein. In the exemplified embodiment, the storage cavity 211 comprises a first reservoir 212 and a second reservoir 213. Furthermore, the housing 210 extends from a first end 214 to a second end 215 along a longitudinal axis B-B. The first end 214 of the housing 210 may be formed by an end cap 216 that is detachable from the remainder of the housing 210 for purposes of filling the storage cavity 211 with the fluid. Thus, the end cap 216 may be removed from the remainder of the housing 210 when it is desired to fill the storage cavity 211 with a fluid as described herein. In some embodiments, the second end 215 of the housing 210 may also be formed by an end cap 217 that is detachable from the remainder of the housing 210, although in other embodiments the second end 215 of the housing 210 may be a closed end of the housing 210 without any end cap thereon.

The housing 210 comprises a divider wall 218 that divides the storage cavity 211 into the first and second reservoirs 212, 213. Specifically, the divider wall 218 extends transversely or substantially transversely across the storage cavity 211 to separate the storage cavity 211 into the first and second reservoirs 212, 213. There is an opening 219 in the divider wall 218 that forms a passageway from the first reservoir 212 to the second reservoir 213. Thus, the first and second reservoirs 212, 213 are in fluid communication with one another. As a result, if fluid is poured into the first reservoir 212, the fluid will pass through the opening 219 in the divider wall 218 and into the second reservoir 213 so that both of the first and second reservoirs 212, 213 become filled with the fluid. This will be described in greater detail below with reference to FIGS. 6A and 6B. Furthermore, it should be noted that in alternative embodiments the first and second reservoirs 212, 213 may not be in fluid communication with one another, but they may instead be separately filled without the fluid leaking out from one of the first and second reservoirs 212, 213 to the other.

The housing 210 comprises a vent aperture 220 at the second end 215 thereof. Furthermore, the personal care implement 100 has an vent aperture 117 that is in fluid communication with the vent aperture 220. Thus, air can enter into the storage cavity 211 through the vent aperture 117, 220 and air can exit the storage cavity 211 through the vent aperture 117, 220 as needed based on changes in temperature, pressure, volume of fluid in the storage cavity 211, and the like. Each of the vent apertures 117, 220 is designed with a specific dimension/size tailored to the physical properties (e.g., viscosity and surface tension) of the fluid stored within the storage cavity 211 such that once system equilibrium is reached, the fluid cannot pass through the vent apertures 117, 220 under normal usage conditions. Stated another way, each of the vent apertures 117, 220 is configured such that a liquid within the storage cavity 211 cannot flow through the vent apertures 117, 220 at ambient temperature and with a pressure equilibrium existing between the storage cavity and the external atmosphere. However, at the same time the vent apertures 117, 220 are designed to permit gas, such as air, within the storage cavity 211 to pass through the vent apertures 117, 220. Specifically, as long as the vent apertures 117, 220 are not clogged, the gas/air will be capable of freely passing through the vent apertures 117, 220 both into and out of the storage cavity 211 as needed to provide proper air intake and venting to ensure proper operation of the device (i.e., consistent fluid flow during use) without leakage. In certain embodiments, the vent apertures 220 may have a diameter in a range of 0.05 mm to 0.5 mm, and more specifically between 0.1 mm and 0.3 mm.

In other embodiments, the fluid supply system 200 may not include the housing 210. Rather, in such embodiments the handle cavity 107 may form the storage cavity 211 and the first and second reservoirs 212, 213 thereof as described below. Thus, rather than having a separate housing defining the storage cavity 211 and the first and second reservoirs 212, 213 thereof, these can be formed by the personal care implement 100 without the need for a separate structure, although a separate divider member may be used to divide the handle cavity 107 into multiple reservoirs where needed.

In the exemplified embodiment, the first reservoir 212 is an empty space of the storage cavity 211 that can be filled (in part or in full) with the fluid as described herein. The second reservoir 213, however, is not left as an empty space in the exemplified embodiment. Rather, as shown in the drawings, an absorbent member 230 is located in the second reservoir 213. In the exemplified embodiment, the absorbent member 230 completely fills the second reservoir 213. Thus, the absorbent member 230 rests atop of the divider wall 219 and extends along the sidewalls of the second reservoir 213 up to the top surface of the second reservoir 213. However, the invention is not to be so limited in all embodiments and the absorbent member 230 may partially fill the second reservoir 213 in other embodiments, and in such embodiments the remainder of the second reservoir 213 may be an empty space.

The absorbent member 230 may be formed of any of the absorbent or capillary materials as described above with the applicator 150. Thus, the absorbent member 230 may be a porous material, a foam, a fibrous material, or the like including all examples provided above with reference to the applicator 150. In some embodiments, the absorbent member 230 may be less dense and more porous than the applicator 150, which creates a density gradient and enables the fluid to flow from the absorbent member 230 to the applicator 150 as described in greater detail below.

In the exemplified embodiment, the second reservoir 213 within which the absorbent member 230 is disposed is located closer to the head 120 and closer to the applicator 150 than the first reservoir 212. Thus, the second reservoir 213 is located between the first reservoir 212 and the applicator 150. As a result, there is a shorter flow path from the second reservoir 213 to the applicator 150 than there is from the first reservoir 212 to the applicator 150. This allows the fluid located in the second reservoir 213 to be used to prime the applicator 150 whereas the fluid in the first reservoir 212 may be used to replenish the applicator 150. The phrase "prime the applicator 150" is intended to mean saturate the applicator 150 with the fluid for the first time. This will be described in greater detail below with reference to FIGS. 6A-7B.

The fluid supply system 200 further comprises a first capillary member 240 and a second capillary member 260. The first capillary member 240 is in fluid coupling with the fluid in the first reservoir 212 and with the applicator 150 to form a first flow path for the fluid from the first reservoir 212 of the fluid supply system 200 to the applicator 150. The second capillary member 260 is in fluid coupling with the fluid in the second reservoir 213 and with the applicator 150 to form a second flow path for the fluid from the second reservoir 213 of the fluid supply system 200 to the applicator 150. The first and second flow paths are distinct from one another as they form completely separate paths from the storage cavity 211 to the applicator 150 with no overlap. Of course, in other embodiments the first and second flow paths could converge at a location between the second reservoir 213 and the applicator 150 if so desired to conserve space or for other purposes.

Referring to FIGS. 2-5, the first capillary member 240 comprises a tube 241 that extends from a first end 242 to a second end 243. The first end 242 of the tube 241 of the first capillary member 240 is located within the first reservoir 212, and preferably at a lower portion of the first reservoir 212. Thus, the first end 242 of the tube 241 is located a first distance D1 from the applicator 150. In the exemplified embodiment, the second end 243 of the tube 241 of the first capillary member 240 is in abutting contact with the applicator 150. In other embodiments, the second end 243 of the tube 241 may be embedded within the applicator 150. In either case, if there is fluid in the first reservoir 212, the fluid will flow from the first reservoir 212 to the applicator 150 via capillary action. In the exemplified embodiment, the tube 241 of the first capillary member 240 is formed of a non-absorbent material. Thus, the fluid is not wicked up along the material of the first capillary member 240 because the first capillary member 240 is formed of a non-absorbent material that does not soak up liquids. Stated another way, at an interface between the liquid and the non-absorbent material, the liquid does not pass through the non-absorbent material. Rather, the tube 241 of the first capillary member 240 comprises a passageway 244 that extends from the first end 242 of the tube 241 to the second end 243 of the tube 241.

The passageway 244 is designed and configured to permit the fluid to flow within the first capillary member 240 from the first end 242 to the second end 243 via a wicking action. Thus, in this manner the fluid is able to flow from its storage location within the first reservoir 212 of the storage cavity 211 of the housing 210 to the applicator 150 so that the applicator 150 can be loaded with the fluid. Specifically, the passageway 244 may have a cross-sectional size and shape that permits flow of the fluid all the way from the storage cavity 211 to the applicator 150 to ensure that the applicator 150 remains loaded with the fluid (see, e.g., FIGS. 7A and 7B discussed below). Thus, the cross-sectional area, size, and shape of the passageway 244 is extremely small, which forces the fluid to flow through the passageway 244 via capillary action as it is known that a liquid will flow in narrow spaces without the assistance of external forces.

In other embodiments, the first capillary member 240 may be formed of an absorbent or porous material, such as any of the materials described above with reference to the applicator 150. In such embodiments the fluid may flow up the first capillary member 240 via a wicking action (also referred to herein as capillary action) due to the material of the capillary member 240. However, it may be undesirable to form the first capillary member 240 out of an absorbent material to prevent leaks that may occur if there are any temperature and/or pressure changes in the environment in which the personal care system 200 is located. Regardless, the first capillary member 240 may be configured so that the fluid flows therethrough naturally via capillary action without the need for a separate pump.

In the exemplified embodiment, the first capillary member 240 has openings into the passageway 244 at the first end 242 (which is the lower-most end thereof) and at the second end 243 (which is the upper-most end thereof). Thus, the fluid within the first reservoir 212 of the storage cavity 211 can only enter into the passageway 244 of the first capillary member 240 through the opening in the first end 242 of the first capillary member 240. There are no other openings along the length of the first capillary member 240 that permit the fluid to enter into the passageway 244 of the first capillary member 240. As a result, in the exemplified embodiment fluid can only enter into the passageway 244 of the first capillary member 240 when the fluid is in contact with the first end 242 of the first capillary member 240. Thus, in certain orientations of the housing 210 and certain fluid levels within the storage cavity 211, the fluid may be unable to enter into the passageway 244 of the first capillary member 240 because it is not in contact with the opening in the first end 242 of the first capillary member 240. Of course, in other embodiments additional openings into the passageway 244 of the first capillary member 240 may be provided.

As noted above, in the exemplified embodiment the second reservoir 213 is located between the first reservoir 212 and the applicator 150. Thus, the first capillary member 240 must extend past the second reservoir 213 in order to get to the first reservoir 212. In the exemplified embodiment, a portion of the first capillary member 240 extends through and is located within the second reservoir 213. However, because the first capillary member 240 is formed by an enclosed tube 241, the first capillary member 240 is not fluidly coupled to the absorbent member 230 or to the fluid located within the second reservoir 213. In other embodiments, there may be a space between the inner surface 106 of the handle 110 and an outer surface of the housing 210 adjacent to the second reservoir 213 and the first capillary member 240 may extend through that space instead of extending through the second reservoir 213.

The first capillary member 240 protrudes from the second end 215 of the housing 210 and into the passageway 172*b* in the neck region of the personal care implement 100. More specifically, in the exemplified embodiment the first capillary member 240 extends through an opening 221 in the second end 215 of the housing 210. The portion of the first capillary member 240 that extends from the second end 215 of the housing 210 is disposed within the passageway 172*b* in the neck region and extends to the applicator 150 to place the first capillary member 240 into fluid coupling with the applicator 150. The first capillary member 240 also extends through an opening 222 in the divider wall 218 so that a portion of the first capillary member 240 that includes the first end 242 thereof is positioned within the first reservoir 212. Thus, a first portion 245 of the first capillary member 240 is located within the first reservoir 212, a second portion 246 of the first capillary member 240 is located within the second reservoir 213 or adjacent to the second reservoir 213 at the same axial location, and a third portion 247 of the first capillary member 240 is located between the second reservoir 213 and the applicator 150 (i.e., within the passageway 172*b*).

In the exemplified embodiment, the first and second capillary members 240, 260 are located in the first and second passageways 172*a*, 172*b* and isolated from one another. In other embodiments, there may be a single passageway in the neck region within which both of the first and second capillary members 240, 260 are disposed. Moreover, it may be possible in some embodiments for the first and second capillary members 240, 260 to be in contact with one another within the passageway in the neck region without affecting the ability of the first and second capillary members 240, 260 to wick the fluid from the respective one of the first and second reservoirs 212, 213 to the applicator 150.

As noted above, the second capillary member 260 is in fluid coupling with the absorbent member 230 and with the applicator 250 to form the second flow path for the fluid from the storage cavity 211 to the applicator 150. The second capillary member 260 comprises an elongated rod 261 that extends from a first end 262 to a second end 263. The first end 262 of the elongated rod 261 is located within the second reservoir 213 and is in contact with the absorbent member 230. The first end 262 of the elongated rod 261 is located a second distance D2 from the applicator 150. In the exemplified embodiment, the second distance D2 from the second end 262 of the second capillary member 260 to the applicator 150 is less than the first distance D1 from the first end 242 of the first capillary member 240 to the applicator 150. Thus, the first capillary member 240 has a greater length than the second capillary member 260 in the exemplified embodiment.

In the exemplified embodiment, the first end 262 of the elongated rod 261 of the second capillary member 260 extends into the absorbent member 230 so that the absorbent member 230 surrounds a lower portion of the second capillary member 260 (i.e., the lower portion of the second capillary member 260 is embedded within the absorbent member 230). However, the invention is not to be so limited in all embodiments and the first end 262 of the elongated rod 261 of the second capillary member 260 may simply contact or abut an upper surface of the absorbent member 230 in other embodiments. In still other embodiments, the second capillary member 260 may be integral with the absorbent member 230 such that they form a single monolithic structure.

Thus, to further distinguish between the first and second capillary members 240, 260, it is noted that both the first and second capillary members 240, 260 may be deemed to be absorbent structures because a liquid can flow along or through the first and second capillary members 240, 260 to be transported from one location to another. However, the absorbent structure of the first capillary member 240 is formed of a non-absorbent material whereas the absorbent structure of the second capillary member 260 is formed of an absorbent material. Further, the liquid is capable of and will in fact flow through an interface or outer surface of the absorbent material of the second capillary member 260, whereas the liquid is incapable of and will not flow through any interface or outer surface of the non-absorbent material. Because an absorbent material may include many pores through which the liquid flows, this distinction is important in some embodiments. In some embodiments, the passageway 244 forms a direct line of sight through the first capillary member 240 from the first end 242 to the second end 243 whereas there is no direct line of sight exists through the second capillary member 260. An absorbent material used to form the second capillary member 260 is one that picks up and retains a liquid distributed throughout its molecular structure causing the solid to swell. A non-absorbent material used to form the first capillary member 240 is one which does not retain a liquid distributed throughout its molecular structure, but rather may include a passageway having a very small cross-sectional shape/area through which a liquid can flow passively via capillary action.

A portion of the elongated rod 261 of the second capillary member 260 extends through an opening 223 in the second end 215 of the housing 210. Thus, the capillary member 260 extends or protrudes from the second end 215 of the housing 210. In the exemplified embodiment, the second end 263 of the elongated rod 261 is in abutting contact with the applicator 150. In other embodiments, the second end 263 of the elongated rod 261 may be embedded within and surrounded by the applicator 150. In either case, the fluid can flow along the elongated rod 261 of the second capillary member 260 from the second reservoir 213 to the applicator 250. No portion of the second capillary member 260 extends into the first reservoir 212. Thus, an entirety of the second capillary member 260 is located between the divider wall 218 and the applicator 150.

In the exemplified embodiment, the second capillary member 260 is formed of an absorbent material. Any of the absorbent or porous materials noted above with reference to the applicator 150 can be used for the second capillary member 260. Thus, rather than having the fluid flow within a passageway of the second capillary member 260 as with the first capillary member 240, the fluid flows along the absorbent material of the second capillary member 260 to flow from the absorbent member 230 in the second reservoir 213 to the applicator 150. Thus, the fluid flows along the material of the second capillary member 260 itself via capillary action much like fluid travels through a sponge or along a paper towel. By forming the second capillary member 260 out of an absorbent material, the second capillary member 260 can absorb and transfer liquid/fluid from any point along its length, rather than only from an opening in its bottom end as with the first capillary member 240. This allows for a quicker transfer of the fluid from the second reservoir 213 to the applicator 150 as compared to the transfer of the fluid from the first reservoir 212 to the applicator 150.

Of course, it may also be possible to form the second capillary member 260 out of a non-absorbent material in other embodiments. In such embodiments, the fluid will still travel faster from the second reservoir 213 to the applicator 150 than from the first reservoir 212 to the applicator 150 because the second reservoir 213 is located closer to the applicator 150 than the first reservoir 212. In some embodiments, the second reservoir 213 may be positioned even closer to the applicator 150 than shown in the drawings to facilitate a speedier transfer of the fluid from the second reservoir 213 to the applicator 150.

As described herein, in some embodiments the first capillary member 240 is formed of a non-absorbent material (e.g., plastic, metal, or the like) and the second capillary member 260 is formed of an absorbent material (e.g., foam, wood, paper, or the like, with additional material examples provided above). As a result, the fluid flows from the first reservoir 212 to the applicator 150 through the first capillary member 240 at a first flow rate and from the second reservoir 213 to the applicator 150 along the second capillary member 260 at a second flow rate that is greater than the first flow rate. This is because wicking a fluid up along absorbent material is a faster way to flow a fluid via capillary action than wicking a fluid along a small cross-sectional area passageway inside of a non-absorbent tube. In some embodiments, the second flow rate may be at least twice as fast as the first flow rate, or at least three times as fast as the first flow rate, or at least four times as fast as the first flow rate, or at least five times as fast as the first flow rate, or at least six, seven, eight, nine, or ten times as fast as the first flow rate.

Furthermore, the second reservoir 213 is closer to the applicator 150 than the first reservoir 212. This, in combination with the fact that the fluid flows along the second capillary member 260 at a faster speed than the fluid flows through the first capillary member 240, causes the applicator 150 to be primed entirely by the fluid in the second reservoir 213. Stated another way, in some embodiments, upon filling the first and second reservoirs 212, 213 with the fluid, the fluid will begin flowing along each of the first and second capillary members 240, 260 towards the applicator 240.

However, in some embodiments all of the fluid in the absorbent member 230 in the second reservoir 213 may be depleted and transferred to the applicator 150 before any of the fluid in the first reservoir 212 is transferred to the applicator 150. As a result, the first flow path including the absorbent member 230 and the second capillary member 260 forms a priming subsystem of the fluid supply system 200 such that the applicator 150 is initially primed with the fluid from the fluid in the absorbent member 230 and the second capillary member 260 only. Because of this, the applicator 150 can be primed much quicker than if the first reservoir 212 and the first capillary member 240 were used for this purpose.

In some embodiments, the absorbent member 230 has a first volume holding capacity and the applicator 150 has a second volume holding capacity. The volume holding capacities are the amount of volume that the absorbent member 230 and the applicator 150 can hold when fully saturated. In some embodiments, the first volume holding capacity of the absorbent member 230 is equal to the second volume holding capacity of the applicator 150. In other embodiments, the first volume holding capacity of the absorbent member 230 is equal to or less than the second volume holding capacity of the applicator 150. Thus, the entire volume of the fluid that is held in the absorbent member 230 can be transferred to the applicator 150. In some embodiments, due to the variation in flow rates noted above, all of the fluid in the absorbent member 230 (which is located in the second reservoir 213) is transferred to the applicator 150 before any of the fluid in the first reservoir 212 reaches the applicator 150.

It should be appreciated that the fluid will only flow in one direction along the second flow path from the absorbent member 230 to the applicator 150. This is achieved by creating a density gradient in the materials of the absorbent member 230, the second capillary member 260, and the applicator 150 to prevent back travel (i.e., to prevent flow of the fluid/liquid in a direction from the applicator 150 to the absorbent member 230). The liquid transfer materials (i.e., the porous or absorbent materials described herein) function because the liquid wants to travel from a less dense (more porous) material to a more dense (less porous) material. The applicator 150 has a greater density than the second capillary member 260 and the absorbent member 230, which makes it so that any liquid in the applicator 150 will not travel down the second capillary member 260. In some embodiments the applicator 150 has a greater density than the second capillary member 260, and the second capillary member 260 has a greater density than the absorbent member 230. In other embodiments the density of the second capillary member 260 may be the same as the density of the absorbent member 230. In still other embodiments, the density of the second capillary member 230 may increase with increasing distance from the absorbent member 230 towards the applicator 150 to ensure movement and flow of the liquid in the desired direction (from less dense to more dense). Thus, various modifications can be made to the densities of the various components (the absorbent member 230, the second capillary member 260, and the applicator 150) to ensure that the liquid will only flow in one direction from the absorbent member 230 towards the applicator 150 and will not flow in the opposite direction from the applicator 150 towards the absorbent member 230. It should also be noted that if changes in pressure and/or temperature occur, the liquid will flow in the path of least resistance, which would be out through the applicator 150 itself rather than back down into the fluid supply system 200.

Figure 6A:
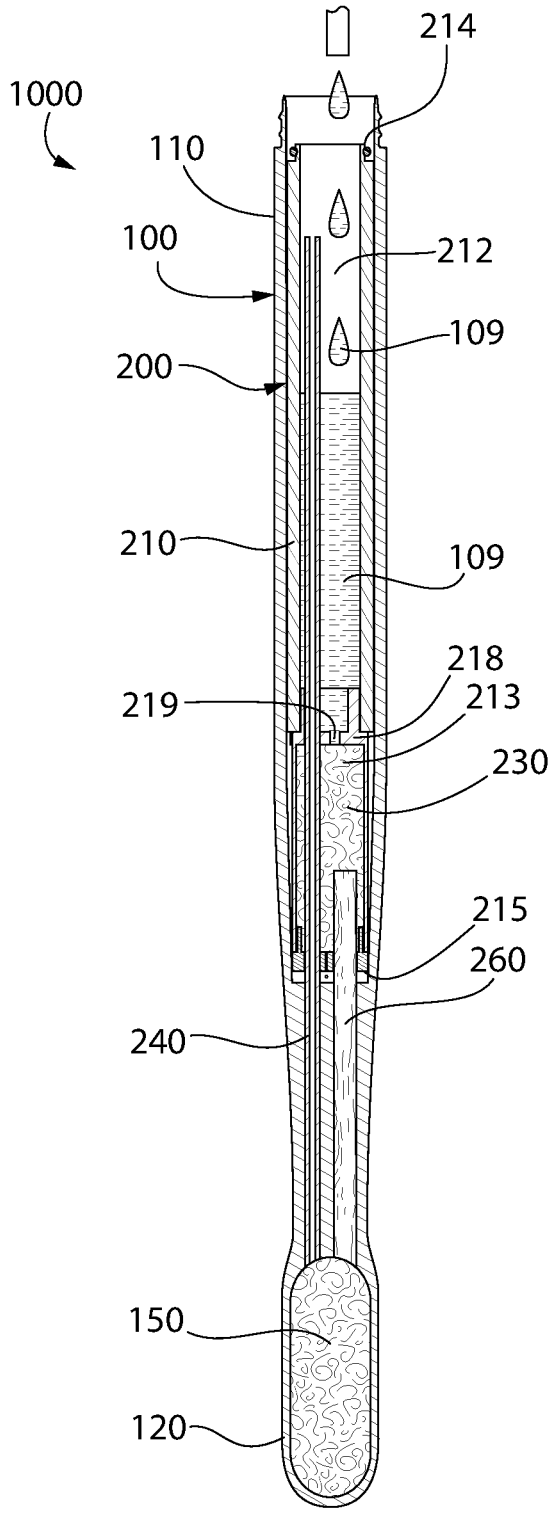
FIG. 6A is the view of FIG. 2 whereby the personal care system is in an upside-down orientation and wherein a fluid supply system thereof is being filled with a fluid.

Referring to FIGS. 6A-6D in succession, the manner in which the first and second reservoirs 212, 213 of the fluid supply system 200 are filled with a fluid 109 and the manner in which the fluid 109 is transferred from the second reservoir 213 to the applicator 150 to prime the applicator 150 with the fluid 109 will be described. First, as shown in FIG. 6A, the end cap 130 is removed from the proximal end 111 of the handle 110 and the end cap 216 is removed from the first end 214 of the housing 210. Next, the personal care system 1000 including the personal care implement 100 and the fluid supply system 200 contained therein is rotated 180° so as to be held in an upside-down orientation. In the upside-down orientation, the head 120 of the personal care implement 100 is located closer to a ground surface (i.e., a floor in a room, the earth, a horizontal support surface, etc.) than the proximal end 111 of the handle 110. Furthermore, in the upside-down orientation the first and second capillary members 240, 260 protrude from the second end 215 of the housing 210 in a direction towards the ground surface. When in the upside-down orientation, the opening in the proximal end 111 of the handle 110 faces upwards in a direction opposite the direction of gravity so that the fluid/liquid can be poured into the storage cavity 211 without spilling out.

Next, the fluid 109 is poured into the storage cavity 211 of the housing 210 through the opening in the first end 214 of the housing 210. As the fluid 109 is poured into the storage cavity 211, the fluid flows into the first reservoir 212, through the opening 219 in the divider wall 218, and into the second reservoir 213 where the fluid 109 soaks or saturates the absorbent member 230. Once the absorbent member 230 is fully saturated with the fluid 109, the fluid will begin to fill the first reservoir 212 because the absorbent member 230 and the second reservoir 213 will not have any more holding capacity for the fluid 109.

Figure 6B:
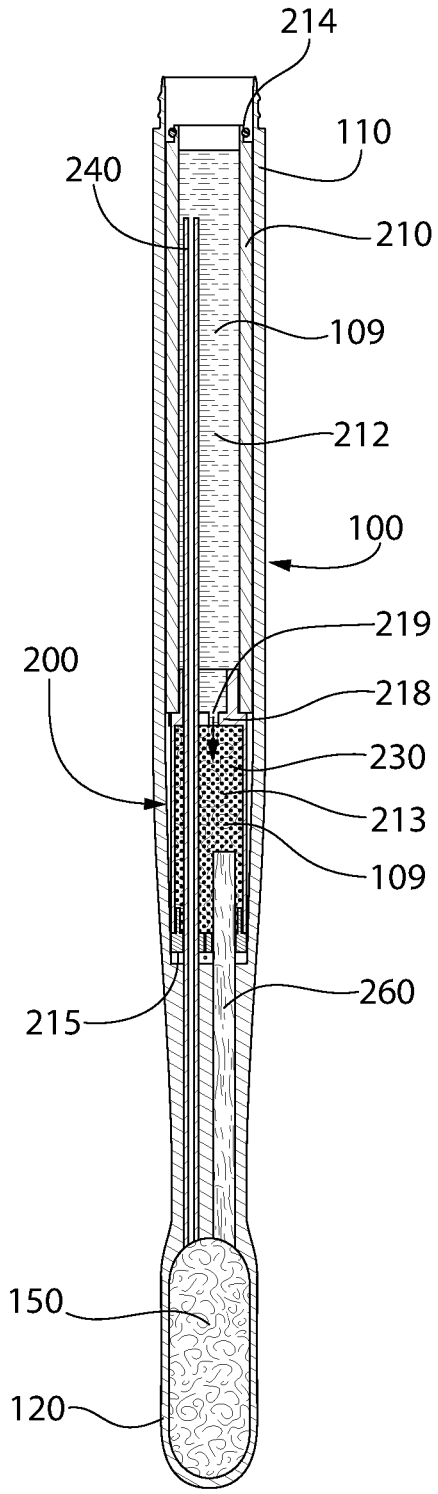
FIG. 6B is the view of FIG. 6A after the fluid supply system has been filled with the fluid.

As shown in FIG. 6B, the first and second reservoirs 212, 213 of the storage cavity 211 have been filled to the desired level. As such, the absorbent member 230 in the second reservoir 213 is saturated or otherwise loaded with the fluid 109, as shown by the darkened color of the absorbent member 230 depicted with rows of black circles. In the exemplified embodiment, the fluid 109 is a liquid, the details of which will be described below. The fluid 109 also at least partially fills the first reservoir 212. Thus, there is a store of the fluid 109 in the first reservoir 212 and the absorbent member 230 in the second reservoir 213 is loaded or at least partially saturated with the fluid 109. The next step in the process is to place the end caps 130, 216 back onto the handle 110 and the housing 210 and to rotate the personal care system 1000 back into a right-side-up orientation, as shown in FIG. 6C.

Figure 6C:
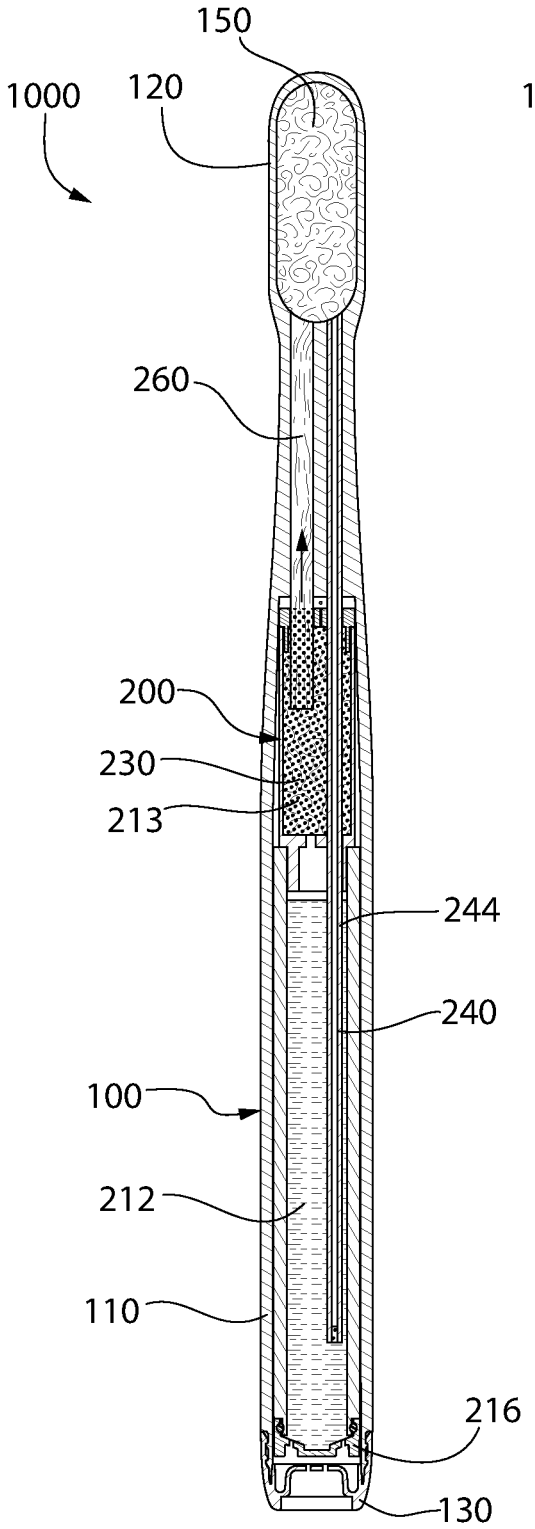
FIGS. 6C and 6D are the view of FIG. 6B whereby the personal care system is in a right-side-up orientation and wherein the fluid is flowing along a second fluid flow path from a reservoir of the fluid supply system to an applicator to prime the applicator with the fluid.

Thus, turning to FIG. 6C, the personal care system 1000 has been rotated 180° back into the right-side-up orientation. In the right-side-up orientation, the head 120 is located furthest from the ground surface and the first and second capillary members 240, 260 extend from the housing 210 in a direction away from the ground surface and in the opposite direction of gravity. As time passes, the fluid 109 in the absorbent member 230 begins wicking up the second capillary member 260 via capillary action. Simultaneously, the fluid 109 in the second reservoir 212 begins wicking upwardly within the passageway 244 of the first capillary member 240.

Figure 6D:
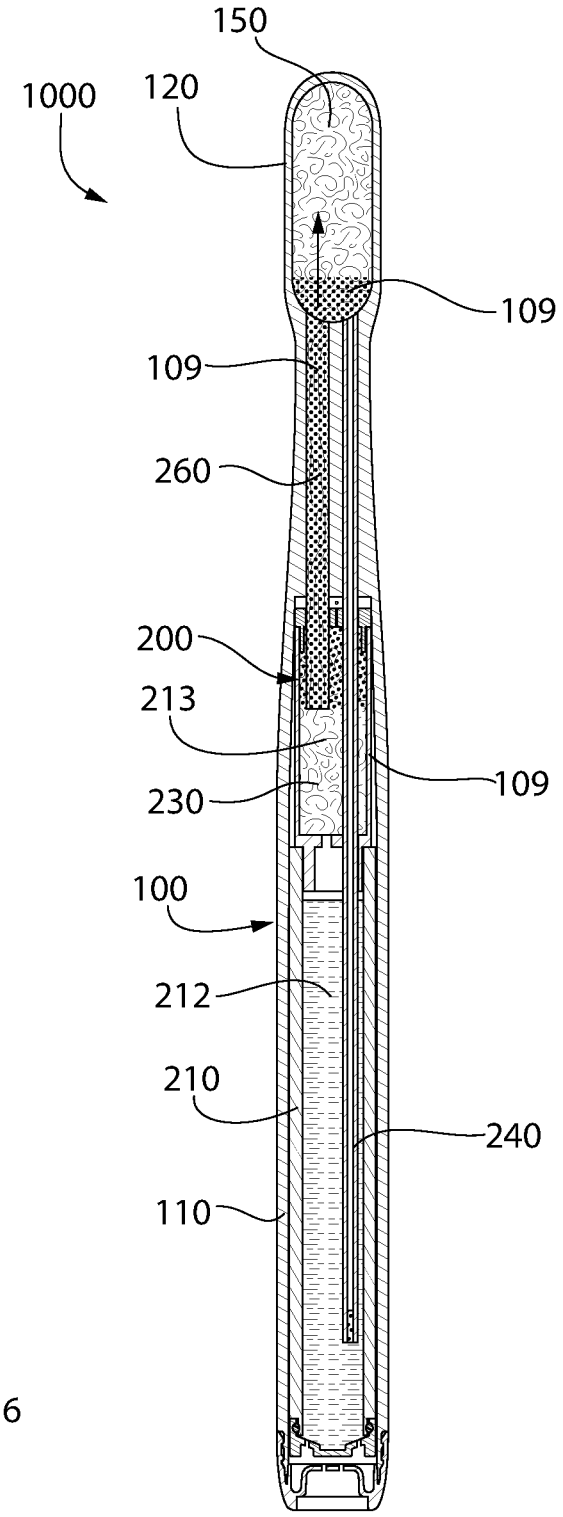

Turning to FIG. 6D, the fluid 109 from the absorbent member 230 has wicked up the second capillary member 260 and begins to saturate the applicator 150. As this is the first time that the applicator 150 is being saturated or loaded with the fluid 109, this process may be referred to as priming the applicator 150 with the fluid 109. The fluid 109 will continue to flow along the second flow path from the absorbent member 230 to the applicator 150 via the second capillary member 260 until the applicator 150 is fully loaded or saturated with the fluid 109 (or at least saturated to a desired threshold, even if it is below a complete saturation). Furthermore, at the same time the fluid 109 continues to flow up the first capillary member 240. However, the fluid 109 flows much more slowly up the first capillary member 240 than it does up the second capillary member 260. This is, at least in part, because in the exemplified embodiment the second capillary member 260 is formed from an absorbent/fibrous material while the first capillary member 240 is an enclosed tube formed from a non-absorbent/fibrous material. Also, because the second reservoir 213 is closer to the applicator 150 than the second reservoir 212, the fluid 109 has a shorter distance to travel from the second reservoir 213 to the applicator 150 than the first reservoir 212 to the applicator 150.

Thus, in some embodiments the first reservoir 212 and the first capillary member 240 do not play any role in the priming of the applicator 150 with the fluid 109. In some embodiments, it may take only a few minutes (e.g., five minutes, ten minutes, twenty minutes) for the fluid 109 flowing along the second flow path (along the second capillary member 260) to reach the applicator 150, whereas it may take several hours for the fluid 109 flowing along the first flow path (along the first capillary member 240) to reach the applicator 150. Therefore, including the second reservoir 213, the second absorbent member 230, and the second capillary member 260 enables the applicator 150 to be primed and saturated more quickly than if those components were omitted. This has benefits in the manufacturing process because the personal care system 1000 cannot be packaged until it can be tested to ensure that it is working properly and that the applicator 150 is becoming saturated with the fluid 109. Failure to identify an assembly issue for ten or more hours (which is how long it would take to saturate the applicator 150 using only the first flow path) would not be feasible and could result in a large quantity of scrap.

Figure 7A:
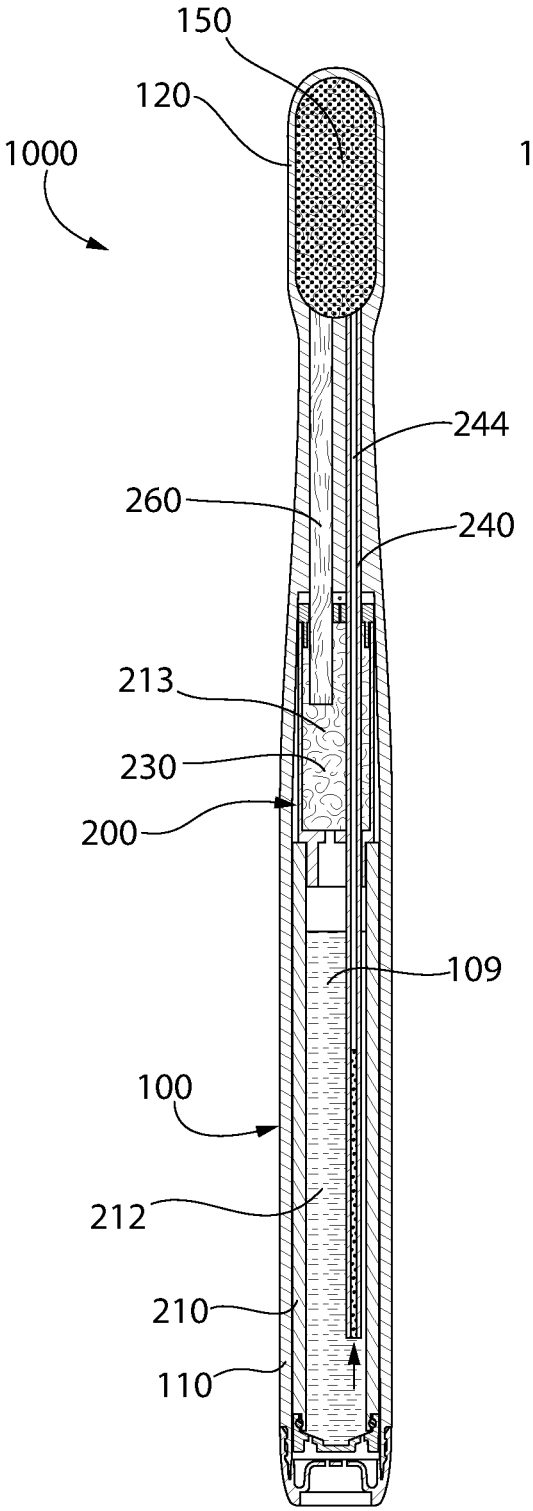
FIGS. 7A and 7B are the view of FIG. 2 after the fluid supply system has been filled with the fluid wherein the fluid is flowing along a second fluid flow path from the reservoir of the fluid supply system to the applicator to replenish the applicator with the fluid.

Referring to FIG. 7A, the applicator 150 is depicted having been fully saturated (or partially saturated to a desired threshold) with the fluid 109. Furthermore, the absorbent member 230 is now depleted of the fluid 109 as all of the fluid 109 from the absorbent member 230 has been transferred to the applicator 150 due to capillary action flow along the second capillary member 260. The fluid 109 is forced to flow from the absorbent member 230 to the applicator 150 via capillary action due to the density gradient noted above.

Furthermore, as shown in FIG. 7A the fluid 109 continues to flow up along the passageway 244 of the first capillary member 240. Despite the applicator 150 being fully or partially saturated, the fluid 109 flowing along the first flow path (from the first reservoir 212 and along the first capillary member 240) has not yet reached the applicator 150. However, the fluid 109 will continue to flow along the passageway 244 of the first capillary member 240 until it reaches the applicator 150 so that upon the applicator 150 depleting some or all of the fluid 109 therefrom, the fluid 109 will flow from the first capillary member 240 to the applicator 150 to replenish the applicator 150 with the fluid 109.

Figure 7B:
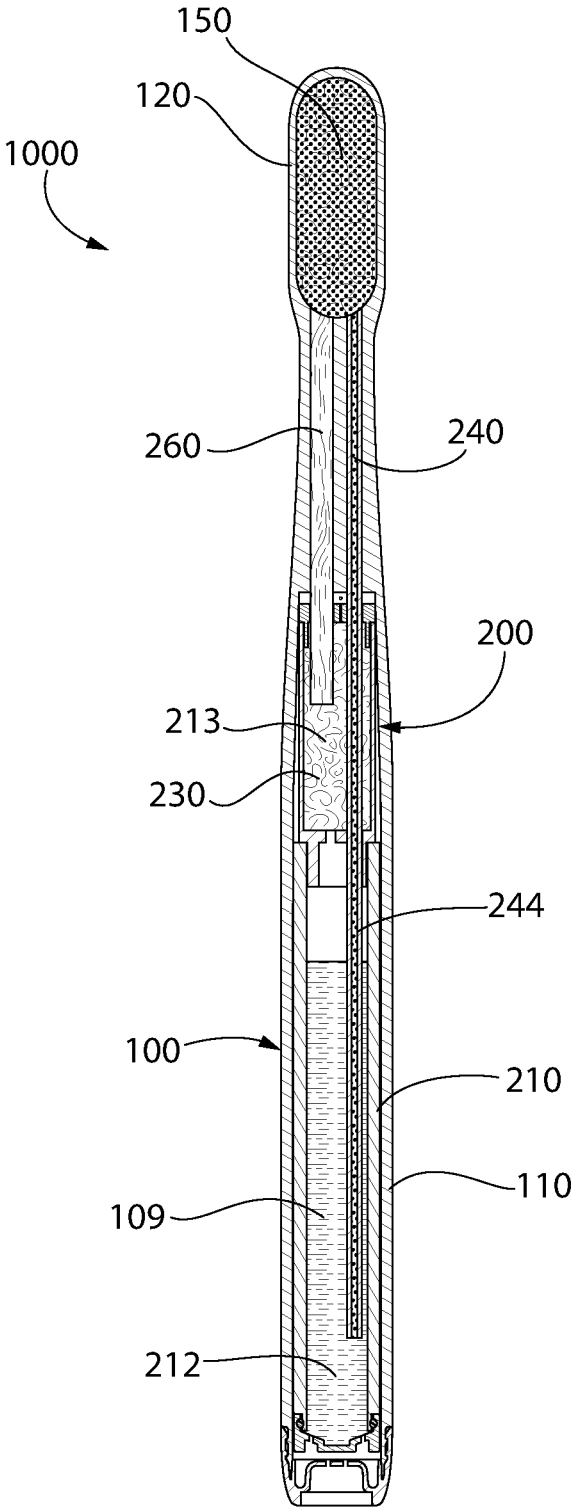

Specifically, as shown in FIG. 7B, the fluid 109 in the passageway 244 of the first capillary member 240 has reached the second end 243 of the first capillary member 240. Thus, if the applicator 150 is not fully saturated, the fluid 109 will flow from the passageway 244 of the first capillary member 240 and into the applicator 150. If the applicator 150 is fully saturated, the fluid 109 will remain in wait at the second end 243 of the first capillary member 240 so that as soon as the applicator 150 dispenses some of the fluid 109, it can be replenished with the fluid 109 in the first capillary member 240.

Thus, when a user uses the personal care implement 100 to clean his/her oral cavity, the pressure of the user's cheek and gums against the applicator 150 will cause some or all of the fluid 109 loaded in the applicator 150 to be dispensed into the oral cavity. As soon as some of the fluid 109 is dispensed from the applicator 150, the fluid 109 in the first capillary member 240 will begin replenishing the applicator 150 with additional amounts of the fluid 109. In some embodiments, if the applicator 150 dispenses all of the fluid 109 therein, it may take several hours for it to become fully saturated from the fluid in the first flow path (in the first capillary member 240 and the first reservoir 212). However, a user typically only brushes his/her teeth twice a day, with approximately ten to twelve hours in between brushings, which is a sufficient amount of time for the applicator 150 to become re-saturated with the fluid 109. This process will continue until the first reservoir 212 is empty of the fluid 109, at which time an additional amount of the fluid 109 can be poured into the first and/or second reservoirs 212, 213 to continue replenishing the applicator 150 (or the personal care implement 100 may be thrown away and replaced).

Figure 8A:
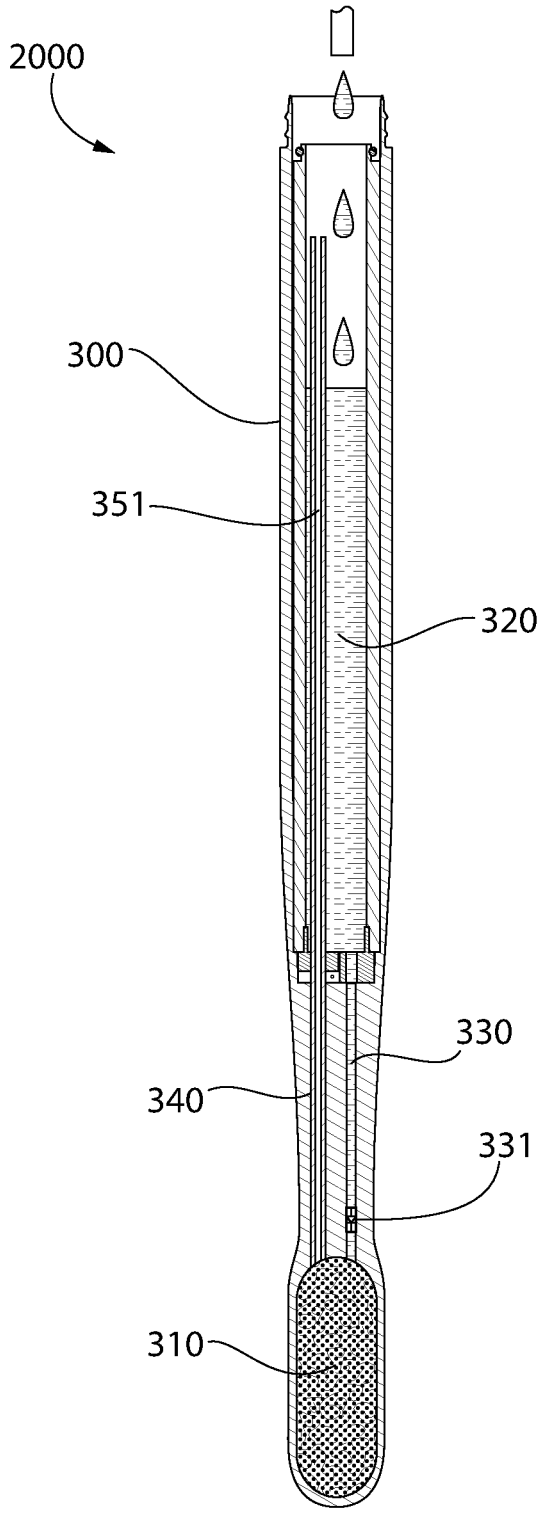
FIGS. 8A and 8B are cross-sectional views similar to FIGS. 6A and 6D in accordance with an alternative embodiment of the present invention.
Figure 8B:
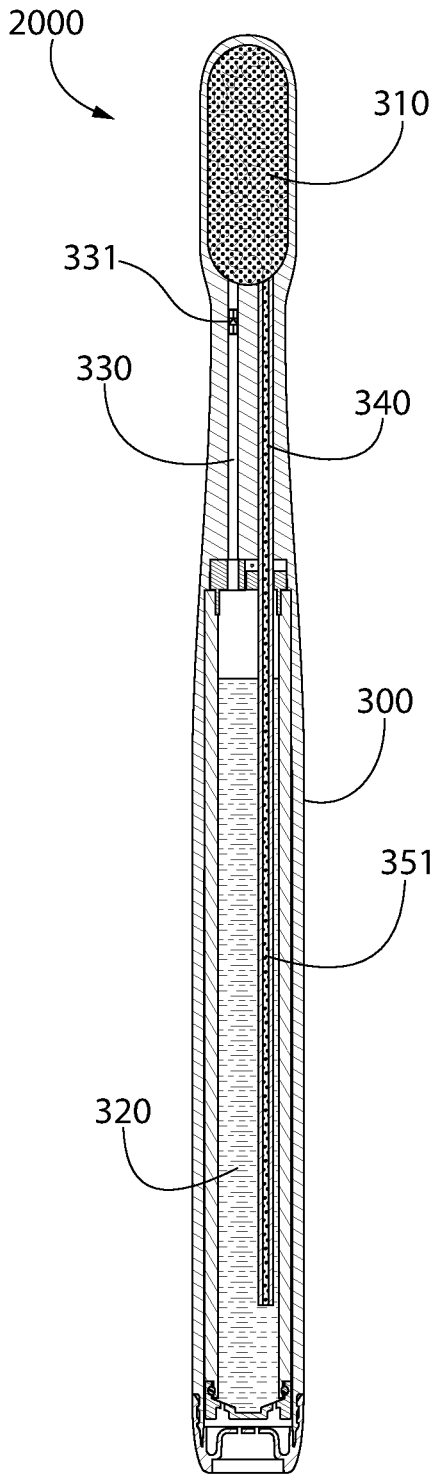

Referring to FIGS. 8A and 8B, in an alternative embodiment, the second reservoir 213, the absorbent member 230, and the second capillary member 260 may be omitted. Thus, FIGS. 8A and 8B illustrate a personal care system 2000 that includes a personal care implement 300 having an applicator 310 and a storage cavity 320. The storage cavity 320 may be defined by a separate housing that is positioned within a handle cavity of the personal care implement 300 as with the previously described embodiments, or the storage cavity 320 may be defined and bounded by an inner surface of the handle of the personal care implement 300 itself. The personal care system 3000 comprises a priming channel 330 extending from the storage cavity 320 to the applicator 310 to form a first flow path for the fluid from the storage cavity 320 to the applicator 310. The personal care system 3000 also comprises a delivery channel 340 extending from the storage cavity 320 to the applicator 310.

In the exemplified embodiment, the priming channel 330 is an empty and hollow space that is free of any material or components therein. Thus, the fluid can flow from the storage cavity 320 through the priming channel 330 to the applicator 310 any time that the personal care implement 300 is in an upside-down orientation as shown in FIG. 8A. There may be a one-way flow restrictor or valve 331 located in the priming channel 330 to prevent the fluid from flowing back from the applicator 310 through the priming channel 330.

The personal care system 2000 comprises a capillary member 350 positioned within the delivery channel 340. In the exemplified embodiment, the capillary member 350 is identical to the first capillary member 240 described above, and thus it is formed of a non-absorbent material and has a capillary passageway 351 extending therethrough. However, the capillary member 350 could be formed of an absorbent material in other embodiments. The capillary member 350 is in fluid coupling with the fluid in the storage cavity 320 and with the applicator 310 to form a second flow path for the fluid from the storage cavity 320 to the applicator 310.

In this embodiment, the fluid is introduced into the storage cavity 320 with the personal care implement 300 in an upside-down orientation as shown in FIG. 8A and previously described. As the fluid is introduced into the storage cavity 320, the fluid flows through the priming channel 330 and into the applicator 310 to saturate the applicator 310 with the fluid. Once the applicator 310 is saturated with the fluid, the personal care implement 300 is rotated from the upside-down orientation into the upright orientation shown in FIG. 8B. Once so rotated, the applicator 310 remains saturated with the fluid and a remainder of the fluid is located within the storage cavity 320. Then, as the personal care implement 300 is used and the fluid is dispensed from the applicator 310 as described above, additional amounts of the fluid can be moved from the storage cavity 320 to the applicator 310 through the capillary member 340 via capillary action.

In certain embodiments, the fluid 109 can be any fluid that is desired to be dispensed for application to a surface (such as a biological surface) depending on the end use. In most cases, the fluid 109 is a liquid as noted above. For example, when the desired application site is a user's oral cavity, the fluid 109 may be one that provides a benefit to a user's oral surfaces (i.e., a benefit agent) such as a sensorial or therapeutic benefit. For example without limitation, the fluid 109 may be a mouthwash, a dentifrice, a tooth whitening agent such as peroxide containing tooth whitening compositions, or the like. Other contemplated fluids that can be stored in the storage cavity 211 include, for example without limitation, antibacterial agents; oxidative or whitening agents; enamel strengthening or repair agents; tooth erosion preventing agents; tooth sensitivity ingredients; gum health actives; nutritional ingredients; tartar control or anti-stain ingredients; enzymes; sensate ingredients; flavors or flavor ingredients; breath freshening ingredients; oral malodor reducing agents; anti-attachment agents or sealants; diagnostic solutions; occluding agents, dry mouth relief ingredients; catalysts to enhance the activity of any of these agents; colorants or aesthetic ingredients; and combinations thereof. In certain embodiments the oral care material is free of (i.e., is not) toothpaste. Instead, the oral care material in such embodiments is intended to provide benefits in addition to merely brushing one's teeth. Other suitable oral care materials could include lip balm or other materials that are typically available in a semi-solid state. Furthermore, in still other embodiments the fluid 109 can be a natural ingredient, such as for example without limitation, lotus seed; lotus flower, bamboo salt; jasmine; corn mint; camellia; aloe; gingko; tea tree oil; xylitol; sea salt; vitamin C; ginger; cactus; baking soda; pine tree salt; green tea; white pearl; black pearl; charcoal powder; nephrite or jade and Ag/Au+.

Thus, when the fluid supply system 200 is stored in an oral care implement or toothbrush, any of the above fluids may be desirable for use as the fluid 109. In other embodiments the personal care implement 100 may not be a toothbrush. Thus, the fluid 109 can be any other type of fluid that has beneficial results when dispensed in accordance with its end use or the end use of the product/implement with which it is associated. For example, the fluid 109 may be hair gel when the implement is a hairbrush, make-up (i.e., mascara or the like) when the implement is a make-up applicator, shaving cream when the implement is a razor, anti-acne cream when the implement is a skin or face scrubber, or the like. Furthermore, as described herein in some embodiments the fluid supply system 200 may not be associated with a personal care implement at all. Thus, the fluid 109 may be modified as desired to be any type of fluid that is desired to be dispensed in accordance with the teachings set forth herein even if it is dispensed directly from the fluid supply system 200 rather than through a personal care implement 100.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A personal care system comprising:

a personal care implement comprising a cavity and an applicator; and a fluid supply system at least partially disposed within the cavity of the personal care implement, the fluid supply system comprising:

a housing defining a first reservoir and a second reservoir, the first reservoir at least partially filled with a fluid;

an absorbent member located in the second reservoir and at least partially saturated with the fluid;

a first capillary member in fluid coupling with the fluid in the first reservoir and with the applicator to form a first flow path for the fluid from the fluid supply system to the applicator; and a second capillary member in fluid coupling with the absorbent member and with the applicator to form a second flow path for the fluid from the fluid supply system to the applicator, the second flow path being distinct from the first flow path.

2. The personal care system according to claim 1 wherein the personal care implement is a toothbrush comprising:

a handle;

a head extending from the handle;

a plurality of tooth cleaning elements extending from the head; and wherein the applicator is located on the head.

3. The personal care system according to claim 1 wherein the fluid flows from the first reservoir to the applicator through the first capillary member at a first flow rate and from the second reservoir to the applicator through the second capillary member at a second flow rate that is greater than the first flow rate.

4. The personal care system according to claim 3 wherein the second flow rate is at least two times faster than the first flow rate such that substantially all of the fluid in the absorbent member is transferred to the applicator before any of the fluid in the first reservoir is transferred to the applicator.

5. The personal care system according to claim 1 wherein the first capillary member comprises a tube formed of a non-absorbent material having a passageway that extends from a first end of the tube that is located in the first reservoir to a second end of the tube that is in contact with the applicator, and wherein the fluid flows within the passageway from the first reservoir to the applicator.

6. The personal care system according to claim 1 wherein the second capillary member comprises an elongated rod formed of an absorbent material, the elongated rod having a first portion that is in contact with the absorbent member and a second portion that is in contact with the applicator, and wherein the fluid flows along the absorbent material of the elongated rod from the absorbent member to the applicator.

7. The personal care system according to claim 1 wherein the first and second reservoirs of the housing are in fluid communication with one another, wherein the housing comprises a divider wall separating an interior cavity of the housing into the first and second reservoirs, and a fluid passageway formed into the divider wall that permits the fluid to flow from the first reservoir into the second reservoir.

8. The personal care system according to claim 1 wherein the personal care implement comprises a handle and a head, the applicator being located on the head, and wherein the second reservoir is located closer to the head than the first reservoir.

9. The personal care system according to claim 1 wherein a first portion of the first capillary member is located within the first reservoir, a second portion of the first capillary member is located within the second reservoir, and a third portion of the first capillary member extends between the second reservoir and the applicator, and wherein a first portion of the second capillary member is located in the second reservoir and a second portion of the second capillary member extends between the second reservoir and the applicator, and wherein no portion of the second capillary member is located in the first reservoir.

10. The personal care system according to claim 1 wherein the applicator is formed of an absorbent material having a greater density than the absorbent member, and wherein the absorbent member has a volume holding capacity that is equal to or less than a volume holding capacity of the applicator.

11. A personal care system comprising:
an applicator; and
a fluid supply system comprising:
a first reservoir and a second reservoir;
an absorbent member located in the second reservoir;
a first capillary member having a first portion located within the first reservoir and a second portion in contact with the applicator; and
a second capillary member having a first portion in contact with the absorbent member and a second portion in contact with the applicator.

12. The personal care system according to claim 11 wherein the first capillary member forms a first flow path for a fluid from the fluid supply system to the applicator and the second capillary member forms a second flow path for the fluid from the fluid supply system to the applicator, the second flow path being distinct from the first flow path.

13. The personal care system according to claim 11 wherein the first capillary member comprises a tube formed of a non-absorbent material having a passageway that extends from a first end of the first capillary member to a second end of the first capillary member.

14. The personal care system according to claim 11 wherein the second capillary member comprises an elongated rod formed of an absorbent material.

15. The personal care system according to claim 11 wherein the second reservoir is located between the applicator and the first reservoir such that a portion of the first capillary member is aligned with or extends through the second reservoir.

16. The personal care system according to claim 11 wherein no portion of the absorbent member is located within the first reservoir, and wherein the first and second reservoirs are in fluid communication with each other.

17. A personal care system comprising:
an applicator; and
a fluid supply system comprising:
a storage cavity at least partially filled with a fluid;
a first capillary member in fluid coupling with the fluid in the storage cavity and with the applicator to form a first flow path for the fluid from the fluid supply system to the applicator, the first capillary member formed of a non-absorbent material; and
a second capillary member in fluid coupling with the fluid in the storage cavity and with the applicator to form a second flow path for the fluid from the fluid supply system to the applicator, the second capillary member formed of an absorbent material.

18. The personal care system according to claim 17 wherein the fluid flows along the first flow path at a first flow rate and along the second flow path at a second flow rate that is greater than the first flow rate.

19. The personal care system according to claim 17 wherein the first capillary member comprises a tube having a passageway and the second capillary member comprises an elongated rod, and wherein the fluid flows within the passageway of the first capillary member from the storage cavity to the applicator and the fluid flows along the absorbent material of the second capillary member from the storage cavity to the applicator.

20. The personal care system according to claim 17 wherein the first capillary member has a first length and the second capillary member has a second length, the first length being greater than the second length.

* * * * *